US009901203B2

(12) United States Patent
Olival

(10) Patent No.: US 9,901,203 B2
(45) Date of Patent: Feb. 27, 2018

(54) UTENSIL ENABLING TO HOLD AND CUT FOOD WITH ONLY ONE HAND

(71) Applicant: Roberto Alexander Olival, Lisboa (PT)

(72) Inventor: Roberto Alexander Olival, Lisboa (PT)

( * ) Notice: Subject to any disclaimer, the term of this patent is extended or adjusted under 35 U.S.C. 154(b) by 87 days.

(21) Appl. No.: 14/891,703

(22) PCT Filed: May 14, 2014

(86) PCT No.: PCT/PT2014/000031

§ 371 (c)(1),
(2) Date: Nov. 17, 2015

(87) PCT Pub. No.: WO2014/185804

PCT Pub. Date: Nov. 20, 2014

(65) Prior Publication Data

US 2016/0113425 A1 Apr. 28, 2016

(30) Foreign Application Priority Data

May 17, 2013 (PT) ..... 106945

(51) Int. Cl.

*A47G 21/08* (2006.01)
*A47G 21/02* (2006.01)
*B26B 11/00* (2006.01)

(52) U.S. Cl.

CPC ..... *A47G 21/08* (2013.01); *A47G 21/02* (2013.01); *B26B 11/00* (2013.01)

(58) Field of Classification Search

CPC ..... A47G 21/02; A47G 21/08; B26B 11/00
See application file for complete search history.

(56) References Cited

U.S. PATENT DOCUMENTS 3,376,640 A 4/1968 Kramer et al.
4,517,741 A * 5/1985 Castelluzzo ..... B26B 5/001 221/212
4,628,717 A * 12/1986 Blum ..... A45C 11/321 30/162
4,667,407 A * 5/1987 Grise ..... A47G 21/08 30/148
4,890,386 A 1/1990 Collier
5,301,428 A * 4/1994 Wilcox ..... B26B 5/001 30/125

FOREIGN PATENT DOCUMENTS

DE 727531 C 11/1942
FR 2466228 A1 4/1981
GB 109739 A 9/1917
GB 292886 A * 6/1928

* cited by examiner

*Primary Examiner* — Stephen Choi
(74) *Attorney, Agent, or Firm* — Mark M. Friedman

(57) ABSTRACT

This invention relates to a utensil enabling to hold and cut food with only one hand and which includes a fork (2) and a knife (5); the fork (2) comprises a slot (1) along the entire holder or handle, two laterals (3) which develop downwards from the upper part of the holder or handle and a locking system of the knife's movement (5) over the fork (2); one knife (5) inserted on the rear segment of the fork (2), to which is attached a platform (4) comprising a V-shaped flap (7) which is arranged in the upper part of the handle; as well as two juxtaposed detents (8), these being fixed to the knife (5) and located under the flap (7).

10 Claims, 9 Drawing Sheets

UTENSIL ENABLING TO HOLD AND CUT FOOD WITH ONLY ONE HAND

SCOPE OF THE INVENTION

This invention relates to a utensil aimed at being used by people which are temporarily or permanently unable to use both hands on their daily routine. This object is designed in order to allow it to be used irrespectively of the member or hand which is immobilized.

STATE OF THE ART

There are on the market some plastic forks which are commonly used by airline companies as well as by kiosks selling ready-made food, which present the hybrid characteristics of a fork and a knife in one same object, wherein the part serving as a knife is fixed to the lateral part of the fork's teeth, thus not allowing the back and forth cutting movement to be performed with only one hand and acting as a "separator" of soft food.

In what concerns this invention, there is nothing similar on the market, in as much as this invention enables the user to perform the required movement with the knife in order to cut solid food, while simultaneously holding the food with the fork, using one hand only.

DESCRIPTION OF THE DRAWINGS

The following description is made with reference to the enclosed drawings which are incorporated for reference purposes only, without any limiting character and wherein.

CAPTIONS

Figure 1:
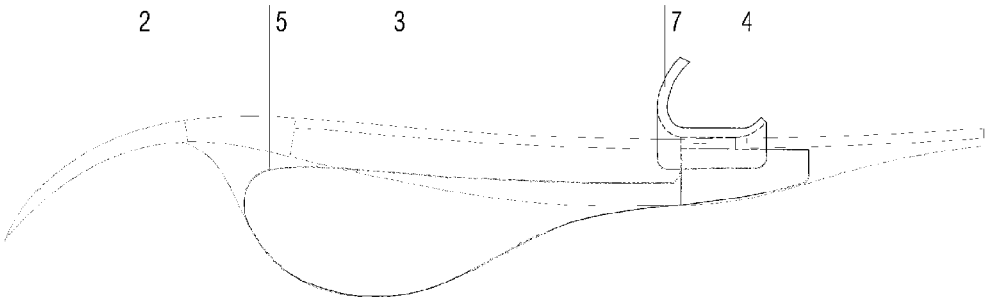
FIG. 1—is a lateral view of the assembled fork and knife, ready to be used.

Aperture of the upper part of the fork (1);
Fork (2);
Lateral (3);
Platform (4) located in the upper part of the knife's handle;
knife (5);
Magnetic area (6);
Flap (7);
Detent (8);
Crossbar (9);
Half-sphere (10); and
Concavity (11).

DETAILED DESCRIPTION OF THE INVENTION

This invention relates to a utensil wherein the conventional function of a fork (2) and a knife (5) is combined in one single object.

The advantages of the invention are intended to solve the difficulties experienced by individuals who are temporarily or permanently unable to use both hands to perform the daily tasks and making it easier to have meals, thus allowing them to regain their independence, since they currently depend from other people, needing them to cut the solid food such as meat or vegetables.

Figure 2:
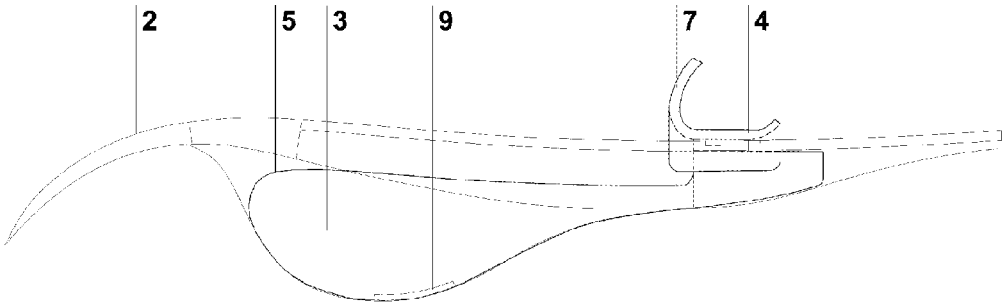
FIG. 2—is a lateral view of the assembled fork and knife ready to be used, with the crossbar.
Figure 3:
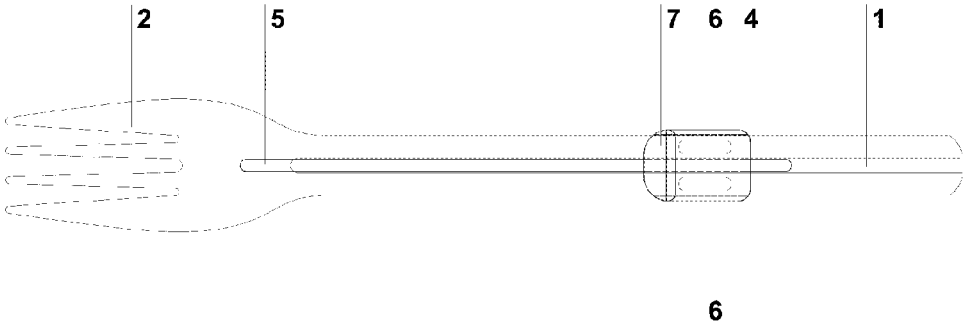
FIG. 3—is a plan view of the assembled fork and knife, ready to be used.
Figure 4:
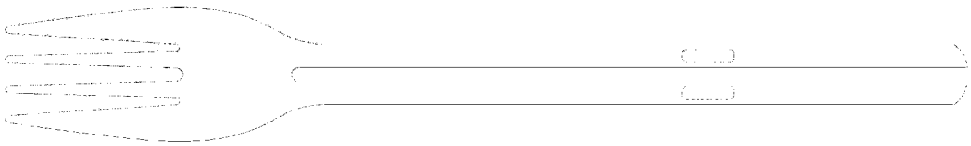
FIG. 4—is a plan view of the fork.
Figure 5:
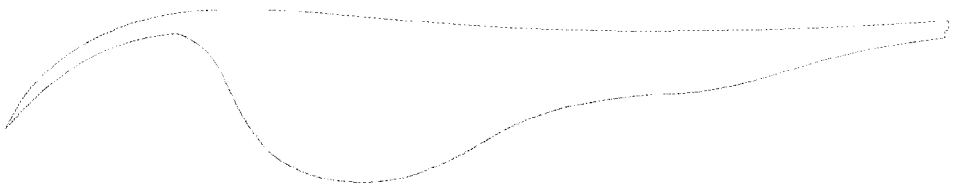
FIG. 5—is a lateral view of the fork.
Figure 6:
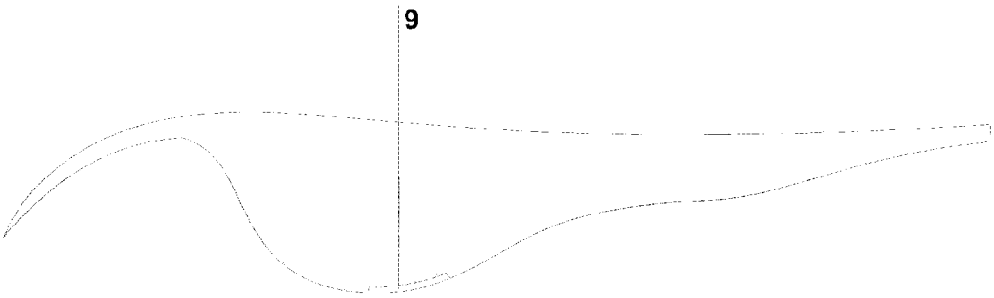
FIG. 6—is a lateral view of the fork, with the crossbar.
Figure 7:
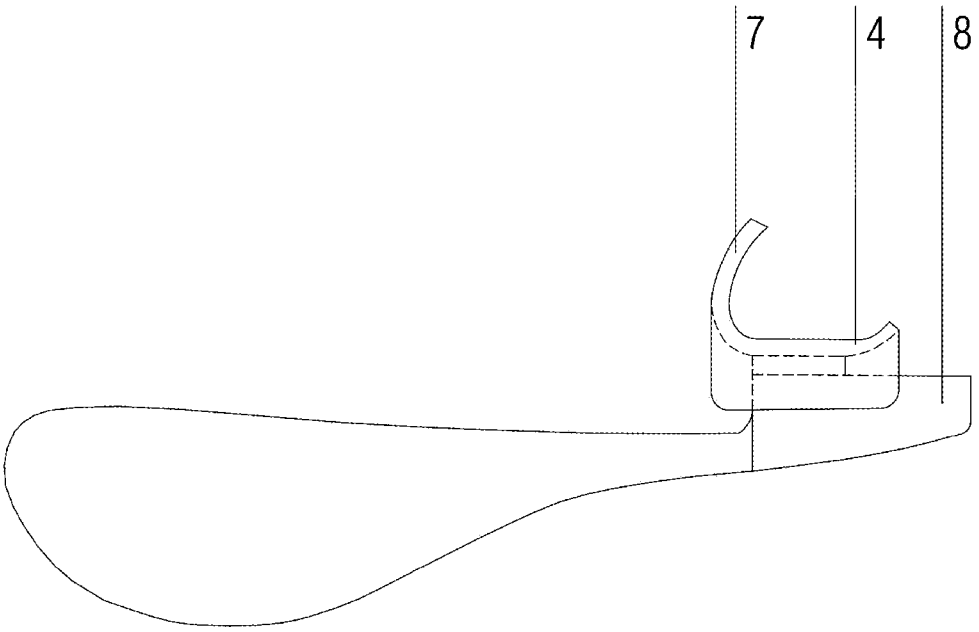
FIG. 7—is a lateral view of the knife.
Figure 8:
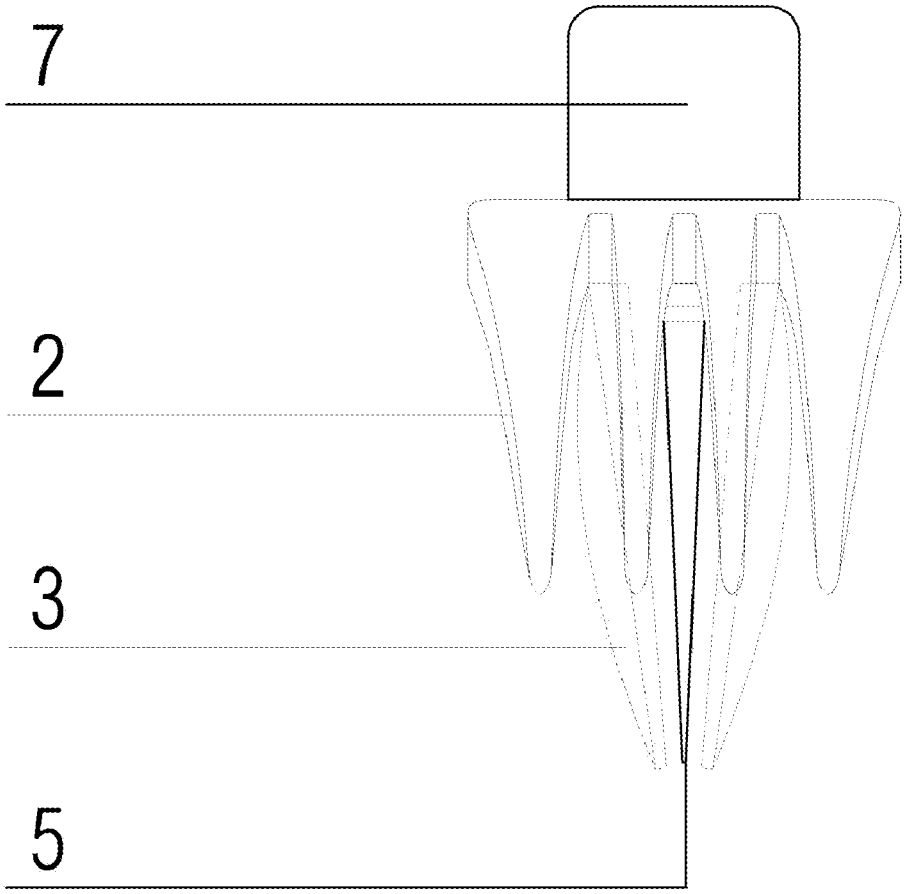
FIG. 8—is a front view of the assembled fork and knife ready to be used.
Figure 9:
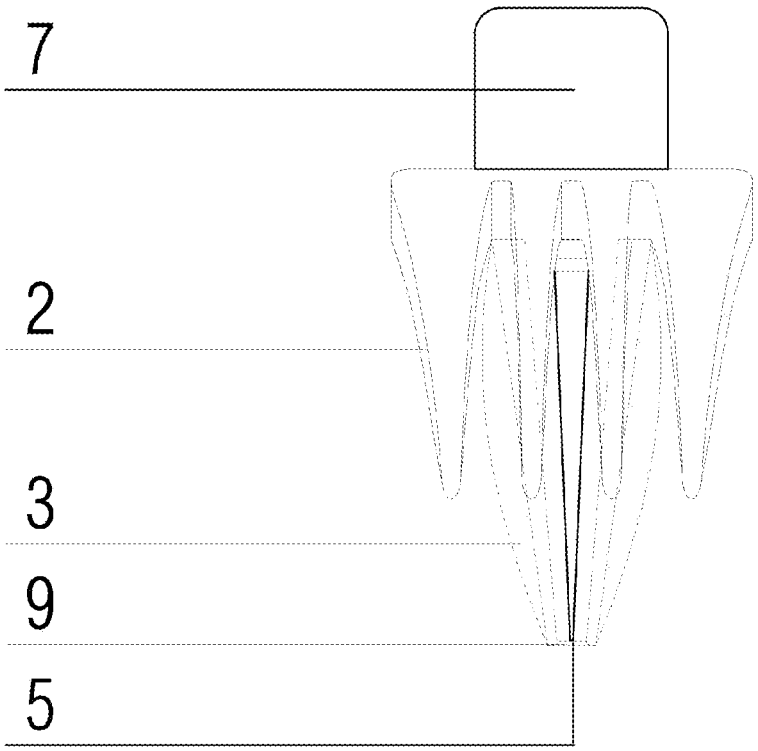
FIG. 9—is a front view of the assembled fork and knife, ready to be used, with the crossbar.
Figure 10:
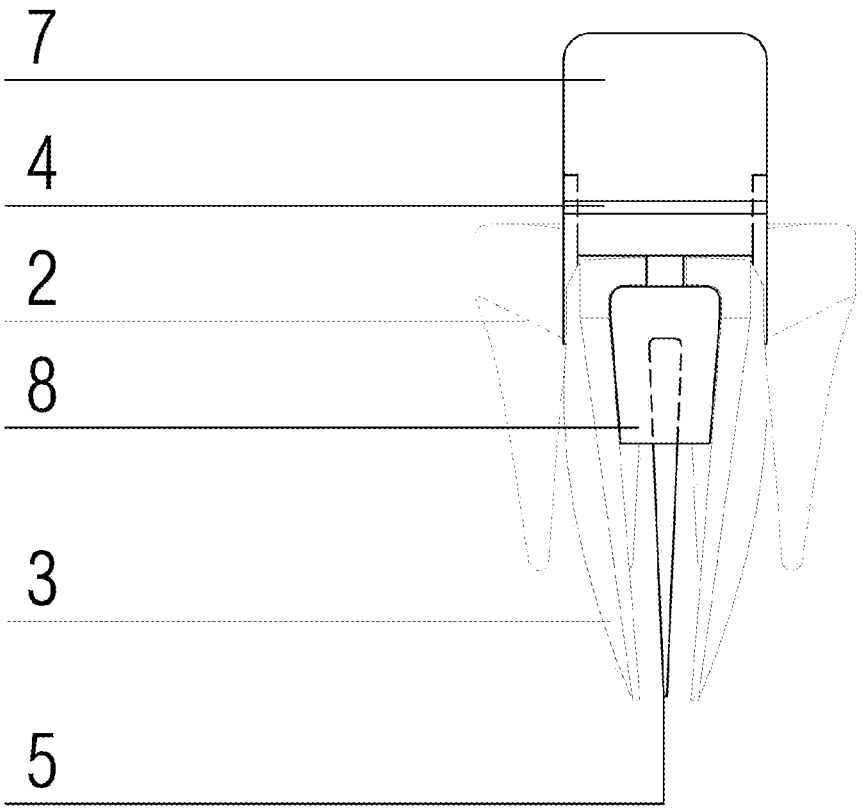
FIG. 10—is a rear view of the assembled fork and knife, ready to be used.
Figure 11:
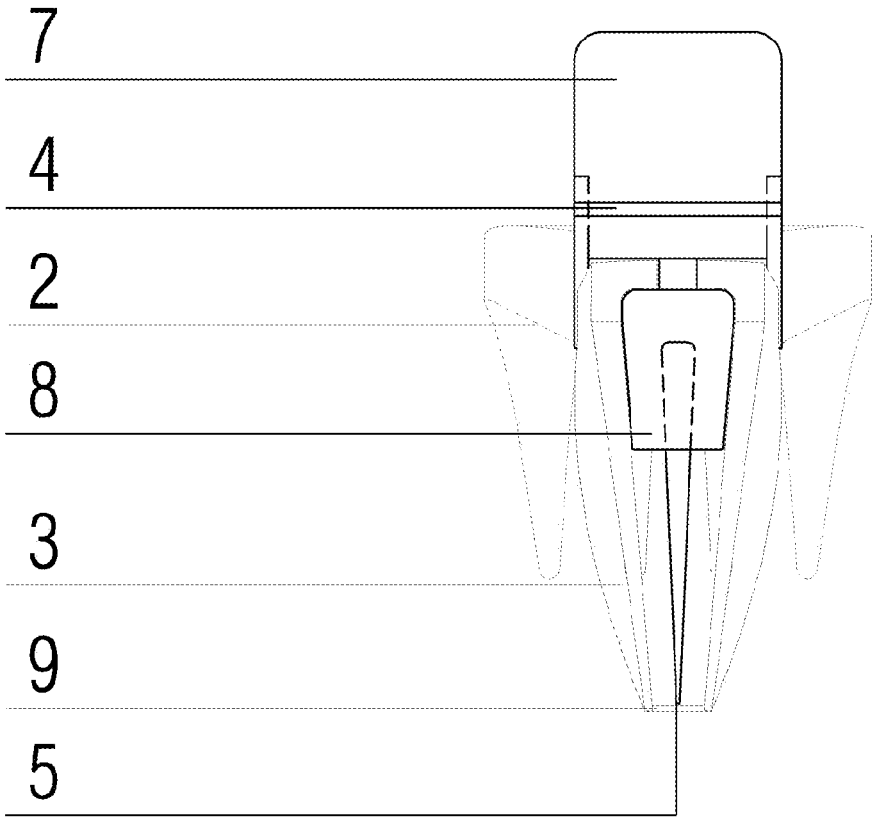
FIG. 11—is a rear view of the assembled fork and knife, ready to be used, with the crossbar.
Figure 12:
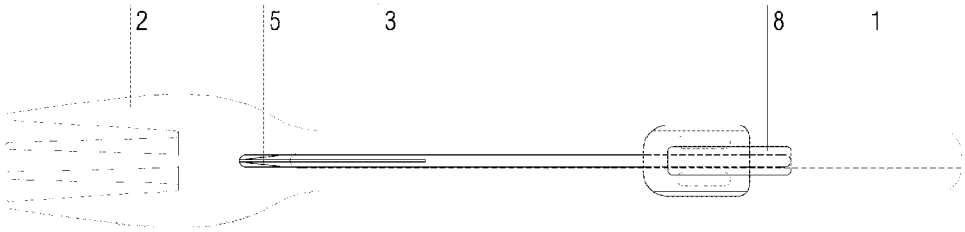
FIG. 12—is a lower view of the assembled fork and knife, ready to be used.
Figure 13:
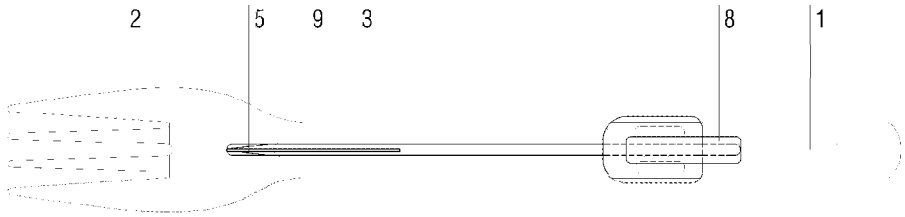
FIG. 13—is a lower view of the assembled fork and knife, ready to be used, with the crossbar.
Figure 14:
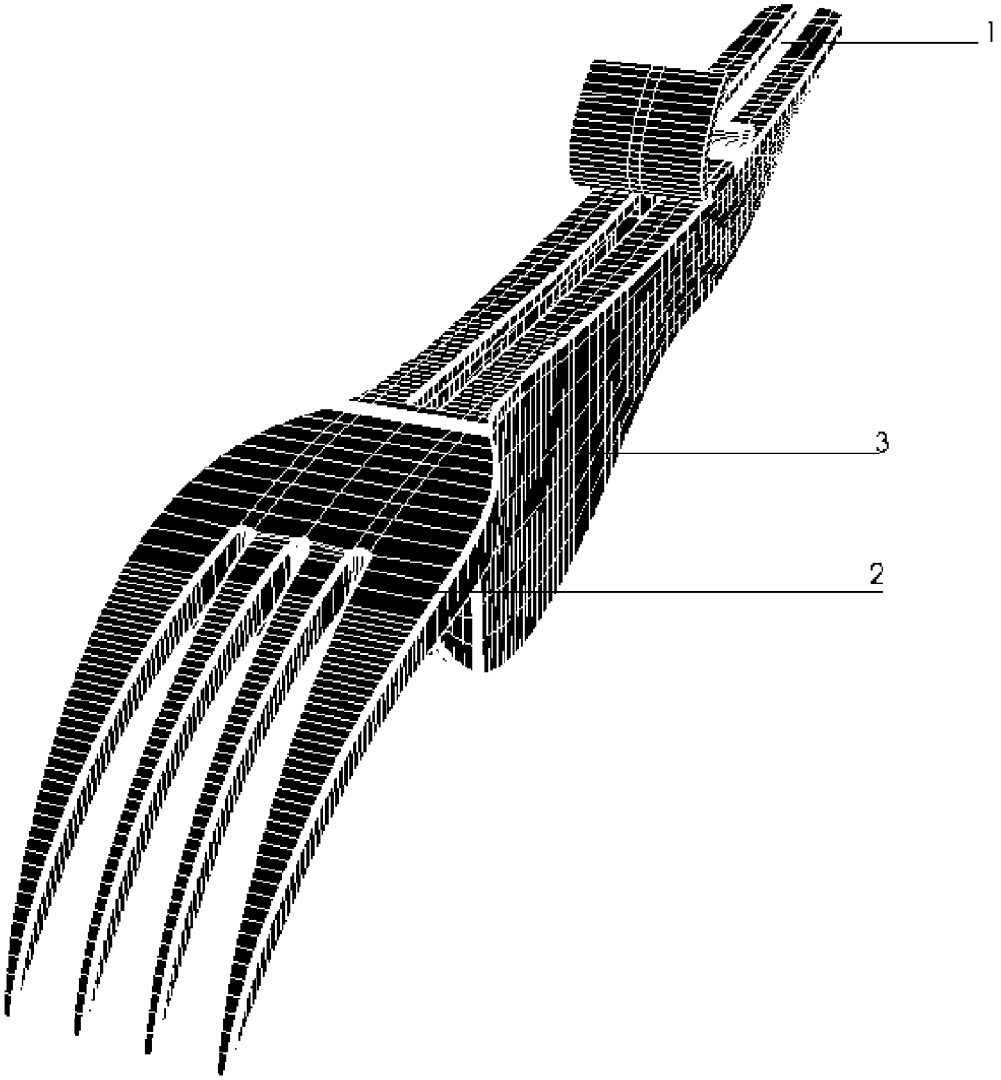
FIG. 14—is a perspective view of the assembled fork and knife, ready to be used.

As can be observed in the FIGS. 1 and 2, the utensil enabling to hold and cut the food with only one hand is comprised of one single object aimed at being used while having meals, and includes a fork (2) and a knife (5).

The fork (2) comprises a slot (1) along the entire holder or handle, two laterals (3), which develop downwards from the upper part of the holder or handle.

The knife (5), to be inserted from the rear segment of the existing slot in the fork (2), to which is attached a platform (4) comprising a V-shaped flap (7) which is arranged in the upper part of the handle, as well as two juxtaposed detents (8), these being fixed to the knife (5) and located under the flap (7).

The laterals (3) of the fork (2) are connected by a crossbar (9) which is located in its lower segment, as depicted in the FIGS. 1, 2, 6, 9 and 13.

The Ease of Use

The whole object was designed for the easiest possible use, since there are no complex mechanisms such as screws or threads needed to assemble or disassemble it. So, if one wishes to assemble the object, it will be enough to slide the knife along the rear part of the fork (2), and then follow the inverse procedure in order to disassemble it.

Durability and Usefulness

As regards the aforementioned forks in the state of the art, this object is intended to be made of a durable metal such as stainless steel or aluminium (to be determined), which enables the user to use it whenever he wants to and for a long period of time if required.

The Product's Safety

Also as regards the existing product on the market, it is understood that the fact of the part eventually serving as a knife being fixed to the lateral part of the fork teeth represents a potential hazard to human health, since the user can easily be hurt and cut himself while taking the food into the mouth, contrarily to what occurs with the present object, which is designed in order to keep the knife locked in the retracted position, and wherein the blade is hidden inside the laterals of the fork, thus eliminating any chance of the user cutting himself while taking the food to the mouth.

Mobility of the Knife (5)

Once again as regards the existing product on the market, this invention distinguishes itself by the fact that the knife is a mobile component which provides the correct and required movement for cutting the solid food.

The "Locking" of the Knife (5)

When in its retracted position, the knife (5) is "locked" by magnetism, due to the fact that the platform (4), which is attached to the upper part of the knife's handle (5), is made from a magnetic metal, which, if placed against the magnetic area inserted into the upper part of the fork's handle (6), will "retain" it magnetically.

Figure 15:
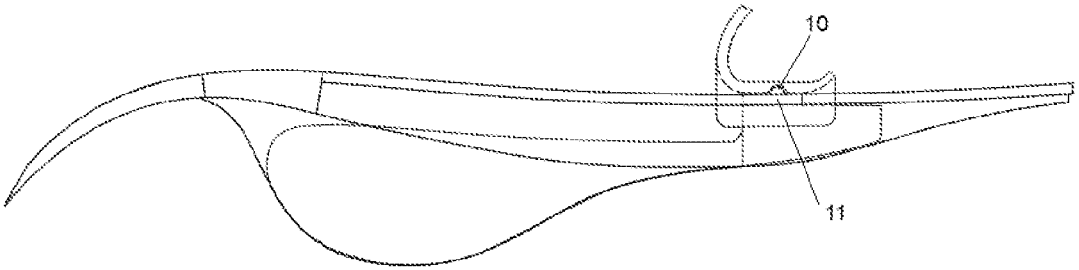
FIG. 15—is a lateral view of the assembled fork and knife, showing an alternative locking mechanism.

According to an alternative locking mechanism shown in FIG. 15, the knife (5) can be locked by means of a half-sphere (10) which is attached to the fork's handle (2) in the locking position, in which case the magnetic area (6) is removed. The sliding of platform (4) up to the locking position will allow the knife (5) to be "retained" when the half-sphere (10) touches the concavity (11) located in the lower part of platform (4).

This invention was devised without complex mechanisms in order to avoid the inadvertent sliding of the knife and causing it to be always locked in the preset position (retracted), thus eliminating the possibility of the user cutting himself. The fact that the components are "locked" by magnetism keeps to a minimum the strength required from the user in order to move the knife from its "locked" position.

The Ergonomics of the Product

The utensil enabling to hold and cut food with only one hand, as disclosed in this invention, allows it to be correctly used both by right- and left handed people, contrarily to the existing product on the market, since the latter has the knife fixed into one of the laterals of the fork teeth, thus allowing it to be used only with the hand for which it was designed.

It should also be stressed that, according to this invention, the movement transmitted to the knife in order to cut the food is performed by putting a finger, usually the index finger, over the flap (7) located in the platform (4) of the knife's handle, which is designed in order to allow a comfortable and "supported" use during the whole movement along the longitudinal axis, whether the said movement is forward or backward.

Embodiments of the Invention

An individual having one hand temporarily or permanently immobilized, needs help to cut the food during meals, since both hands are required, i.e. one to use the fork and hold the food and the other to use the knife and cut the food. This invention provides the solution to these individuals by combining in one same object the common features and basic functions of the conventional cutlery.

The shape both of the fork (2) and the knife comprising the invention will be laser-cut from "sheets" of a metal to be determined for the construction of the same.

As regards the fork (2), after the cut, the fork teeth (2) will be moulded so that they provide the appropriate angle for use, the said angle ranging between 45° and 65°, then inserting the magnetic area into the fork's handle (2) which will allow the knife (5) to be locked.

As regards the knife (5), after the cut, the blade will be moulded so that it presents tilt angles between 94° and 154°, and the platform (4) will be attached by means of "soldering" to the upper part of the handle, thus allowing the user to perform the movement required to cut the food, the said platform (4) being also the metal part which is needed for the purpose of locking the knife (5).

According to an alternative embodiment, the knife (5) can be locked by using a half-sphere (10) which is attached to the fork's handle (2) in the locking position, in which case the magnetic area (6) is removed. The sliding of platform (4) up to the locking position will allow the knife (5) to be "retained" when the half-sphere (10) touches the concavity (11) located in the lower part of platform (4).

Advantages of this Invention

The advantages of this product when compared to the products already existing in the state of the art are the following:

- increased self-esteem of the user; and
- individuals who, regardless of the reason, have one hand or arm temporarily or permanently immobilized, and who are in a situation of dependence from other people in what concerns the performance of some daily tasks, can benefit from this invention in as much as it allows them to regain their independence when they are having meals.

As will be evident to a person skilled in the art, several details are susceptible of modification. However, said modifications shall be included in the scope of this invention.

The invention shall be limited only by the spirit and scope of the following claims.

The invention claimed is:

1. A utensil for use during meals which enables a user to hold and cut food with only one hand, comprising an integral body, the integral body comprising:

- a fork which comprises
  - a holder;
  - a slot located along a length of the holder;
  - and two laterals developing downwards from an upper part of the holder;
- a knife which is inserted in a rear segment of the slot and which comprises:
  - a handle;
  - a platform which is attached to an upper part of said handle and which comprises a V-shaped flap;
  - two juxtaposed detents which are located under the V-shaped flap; and
  - a locking mechanism for safely storing the knife over the fork, when the knife is in a non-operating position;

wherein a cutting motion is enabled by a back and forth movement of said knife inside said slot.

2. The utensil of claim 1 wherein said locking mechanism comprises a first magnetic area located in said holder and a second magnetic area located in said platform.

3. The utensil of claim 1, wherein said locking mechanism comprises a half-sphere located in said holder and a concavity located in a lower part of said platform.

4. The utensil of claim 1 wherein said platform, said detents, and an area of said handle lying between the platform and the detents together form an "H" shaped element which slides in said slot.

5. The utensil of claim 1, wherein said fork comprises teeth which from an angle with respect to a longitudinal axis of the holder, said angle having a value in a range from 45° to 65°.

6. The utensil of claim 1 wherein said knife comprises a blade which is set at a tilt angle with respect to a plane of said handle, said tilt angle having a value in a range from 94° to 154°.

7. The utensil of claim 1 wherein said locking mechanism comprises a first area of magnetic material located in said platform and a second area of magnetic material located in said fork.

8. The utensil according to claim 1 wherein said flap acts as a finger support in order to enable a user to apply pressure while cutting.

9. The utensil of claim 1 wherein said laterals are structural elements of said fork.

10. The utensil of claim 1 wherein a lower segment of said fork comprises a crossbar that connects said laterals.

* * * * *